US010436485B2

(12) United States Patent
D'Souza

(10) Patent No.: US 10,436,485 B2
(45) Date of Patent: Oct. 8, 2019

(54) SEALED SYSTEM FOR A PACKAGED TERMINAL AIR CONDITIONER UNIT

(71) Applicant: Haier US Appliance Solutions, Inc., Wilmington, DE (US)

(72) Inventor: Bryan Isaac D'Souza, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/811,748

(22) Filed: Nov. 14, 2017

(65) Prior Publication Data

US 2019/0145676 A1 May 16, 2019

(51) Int. Cl.

| | |
|---|---|
| ***F25B 43/00*** | (2006.01) |
| ***F25B 41/04*** | (2006.01) |
| ***F25B 13/00*** | (2006.01) |

(52) U.S. Cl.

CPC ..... *F25B 43/003* (2013.01); *F25B 13/00* (2013.01); *F25B 41/04* (2013.01); *F25B 2400/0413* (2013.01)

(58) Field of Classification Search

CPC ..... F25B 43/003; F25B 13/00; F25B 2400/0413; F25B 41/04

See application file for complete search history.

(56) References Cited

U.S. PATENT DOCUMENTS

| | | | | | |
|---|---|---|---|---|---|
| 2,791,099 | A * | 5/1957 | Jordan | F25B 5/00 | 62/152 |
| 2,991,631 | A * | 7/1961 | Ray | F25B 41/046 | 137/625.11 |
| 3,066,497 | A * | 12/1962 | Dubberley | F25B 13/00 | 62/299 |
| 3,175,342 | A * | 3/1965 | Balogh | F25B 43/003 | 96/132 |
| 3,482,415 | A * | 12/1969 | Trask | F25B 13/00 | 62/222 |
| 4,029,580 | A * | 6/1977 | Lange | B01D 35/02 | 210/136 |
| 4,125,469 | A * | 11/1978 | Henton | B01D 35/15 | 210/136 |
| 4,177,145 | A * | 12/1979 | Schumacher | B01D 35/12 | 210/136 |

(Continued)

FOREIGN PATENT DOCUMENTS

JP 2007024351 A 2/2007

*Primary Examiner* — Kun Kai Ma

(74) *Attorney, Agent, or Firm* — Dority & Manning, P.A.

(57) ABSTRACT

A packaged terminal air conditioner unit (PTAC) includes a sealed system having an outdoor heat exchanger and an indoor heat exchanger fluidly coupled through a line filter assembly. The line filter assembly includes a housing defining an indoor port having a first cross sectional area and being fluidly coupled to the indoor heat exchanger, a bypass port having a second cross sectional area smaller than the first cross sectional area, and an outdoor port fluidly coupled to the outdoor heat exchanger. A line filter is coupled to outdoor port for filtering the flow of refrigerant passing in one direction and a check valve within the housing prevents flow through the line filter in the opposite direction. A bypass conduit provides fluid communication between the bypass port and the outdoor conduit to bypass the line filter.

19 Claims, 8 Drawing Sheets

(56) References Cited

U.S. PATENT DOCUMENTS 4,227,901 A * 10/1980 Lange ..... B01D 15/00 96/133
4,233,818 A * 11/1980 Lastinger ..... F24D 15/04 236/92 B
4,320,000 A * 3/1982 Lange ..... B01D 15/00 210/117
4,637,881 A * 1/1987 Sciuto ..... B01D 27/00 210/689
4,756,166 A * 7/1988 Tomasov ..... F25B 41/062 62/217
5,038,582 A * 8/1991 Takamatsu ..... F25B 41/006 62/474
5,832,741 A * 11/1998 Hutchison ..... B01D 53/261 62/475
D419,217 S 1/2000 Lee
6,286,322 B1 * 9/2001 Vogel ..... F25B 47/025 62/278
9,212,835 B1 * 12/2015 Berens ..... F25B 27/00
2003/0121278 A1 * 7/2003 Ichimura ..... F25B 43/003 62/474
2006/0179864 A1 * 8/2006 Choi ..... F25B 41/003 62/292
2010/0212861 A1 * 8/2010 Setsu ..... F24F 1/027 165/64
2011/0023853 A1 * 2/2011 Lund ..... F02D 19/0647 123/590
2011/0100041 A1 * 5/2011 Crawford ..... F25B 13/00 62/156
2012/0047931 A1 * 3/2012 Mangum ..... F25B 49/027 62/186
2015/0089966 A1 * 4/2015 Qu ..... F25D 21/006 62/80
2016/0252260 A1 * 9/2016 Jewell ..... F24F 1/022 62/259.1

* cited by examiner

SEALED SYSTEM FOR A PACKAGED TERMINAL AIR CONDITIONER UNIT

FIELD OF THE INVENTION

The present subject matter relates generally to refrigeration systems, and more particularly to sealed cooling systems and air conditioner units.

BACKGROUND OF THE INVENTION

Refrigeration systems are generally utilized adjust the temperature within a certain area. In the case of air conditioner units, one or more units may operate to adjust the temperature within structures such as dwellings and office buildings. In particular, one-unit type room air conditioner units may be utilized to adjust the temperature in, for example, a single room or group of rooms of a structure. Such air conditioner units may include, for instance, a sealed system to cool or heat the room. The sealed system may include a compressor, one or more heat exchangers, and an expansion device.

Conventional systems are often formed from various components that are designed for specific operating conditions. As an example, the components of a conventional sealed system may be generally designed to draw heat from (i.e., cool) air directed therethrough. Thus, the sealed system will be optimized to absorb heat from incoming air before directing cooled air away from the sealed system and out of the air conditioner. In some instances, it may be possible to reverse this operation to impart heat to incoming air before directing the heated air away from the sealed system and out of the air conditioner. Although such a system might be alternately used to generate a cooling effect and a heating effect, it is generally not possible to provide an ideal configuration for each effect. For instance, the ideal amount of refrigerant or air flow through or across a specific component may be different for generating a cooling effect than it would be for generating a heating effect. Moreover, in some instances, undesirable particulate, such as contaminates imparted to the compressor during assembly, may flow to various downstream components. Reversing the operation of the sealed system may cause these particulates to flow back into the sealed system, potentially damaging one or more components, such as the compressor itself.

Accordingly, a sealed heat exchange system, as within an air conditioner, that could be readily optimized for cooling operations and heating operations would be useful. More specifically, a sealed system including a bypass route for heat pump operation that is easy to manufacture and assemble would be particularly beneficial.

BRIEF DESCRIPTION OF THE INVENTION

The present subject matter provides a packaged terminal air conditioner unit (PTAC) including a sealed system having an outdoor heat exchanger and an indoor heat exchanger fluidly coupled through a line filter assembly. The line filter assembly includes a housing defining an indoor port having a first cross sectional area and being fluidly coupled to the indoor heat exchanger, a bypass port having a second cross sectional area smaller than the first cross sectional area, and an outdoor port fluidly coupled to the outdoor heat exchanger. A line filter is coupled to outdoor port for filtering the flow of refrigerant passing in one direction and a check valve within the housing prevents flow through the line filter in the opposite direction. A bypass conduit provides fluid communication between the bypass port and the outdoor conduit to bypass the line filter. Additional aspects and advantages of the invention will be set forth in part in the following description, may be obvious from the description, or may be learned through practice of the invention.

In accordance with one embodiment, a packaged terminal air conditioner unit is provided including a bulkhead positioned within a casing and defining an interior side portion and an exterior side portion. An outdoor heat exchanger is disposed in the exterior side portion and an indoor heat exchanger is disposed in the interior side portion. A compressor is operable to urge a flow of refrigerant through the indoor heat exchanger and the outdoor heat exchanger and a line filter assembly fluidly couples the indoor heat exchanger to the outdoor heat exchanger. The line filter assembly includes a housing defining an indoor port having a first cross sectional area, a bypass port having a second cross sectional area smaller than the first cross sectional area, and an outdoor port. An indoor conduit provides fluid communication between the indoor port and the indoor heat exchanger and an outdoor conduit provides fluid communication between the outdoor port and the outdoor heat exchanger. A line filter is operably coupled to the outdoor conduit for filtering the flow of refrigerant and a check valve is positioned within the housing, the check valve being configured for preventing the flow of refrigerant from passing from the indoor port to the outdoor port. A bypass conduit provides fluid communication between the bypass port and the outdoor conduit.

In accordance with another embodiment, a line filter assembly for a sealed heat exchange system is provided. The line filter assembly includes a housing defining an indoor port having a first cross sectional area, a bypass port having a second cross sectional area smaller than the first cross sectional area, and an outdoor port. A check valve is positioned within the housing, the check valve being configured for preventing a flow of refrigerant from passing from the indoor port to the outdoor port. A line filter is fluidly coupled to the outdoor port of the housing and comprising a filter media for filtering the flow of refrigerant. A bypass conduit provides fluid communication between the bypass port and a bypass discharge, the filter media being positioned between the bypass discharge and the housing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
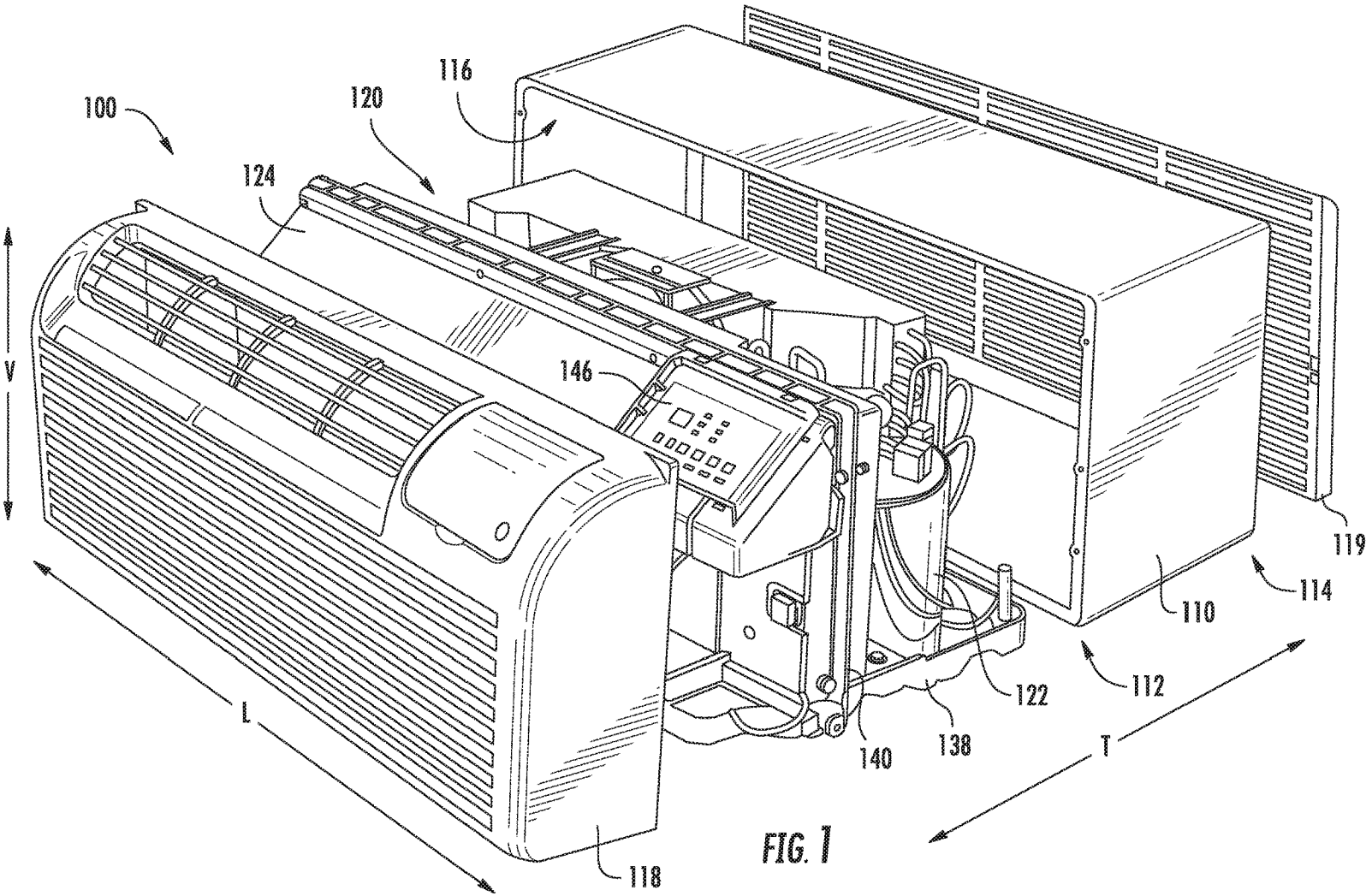
FIG. 1 provides an exploded perspective view of a packaged terminal air conditioner unit according to example embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to example embodiments of the present disclosure. Generally, packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 (i.e., sealed heat exchange system) of packaged terminal air conditioner unit 100 is disposed within a casing 110. Thus, packaged terminal air conditioner unit 100 may be a self-contained or autonomous system for heating and/or cooling air. Packaged terminal air conditioner unit 100 defines a vertical direction V, a lateral direction L, and a transverse direction T that are mutually perpendicular and form an orthogonal direction system.

As used herein, the term "packaged terminal air conditioner unit" is applied broadly. For example, packaged terminal air conditioner unit 100 may include a supplementary electric heater (not shown) for assisting with heating air within the associated room or building without operating the sealed system 120. However, as discussed in greater detail below, packaged terminal air conditioner unit 100 may also include a heat pump heating mode that utilizes sealed system 120, e.g., in combination with an electric resistance heater, to heat air within the associated room or building.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 hinder or limit access to mechanical compartment 116 of casing 110. Front panel 118 is positioned at or adjacent interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall or bulkhead 140 positioned within mechanical compartment 116 of casing 110. Sealed system 120 is positioned on bottom tray 138. Thus, liquid runoff from sealed system 120 may flow into and collect within bottom tray 138. Bulkhead 140 may be mounted to bottom tray 138 and extend upwardly from bottom tray 138 to a top wall of casing 110. Bulkhead 140 limits or prevents air flow between interior side portion 112 of casing 110 and exterior side portion 114 of casing 110 within mechanical compartment 116 of casing 110. Thus, bulkhead 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is operably coupled to various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

In some embodiments, controller 146 includes memory and one or more processing devices. For instance, the processing devices may be microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
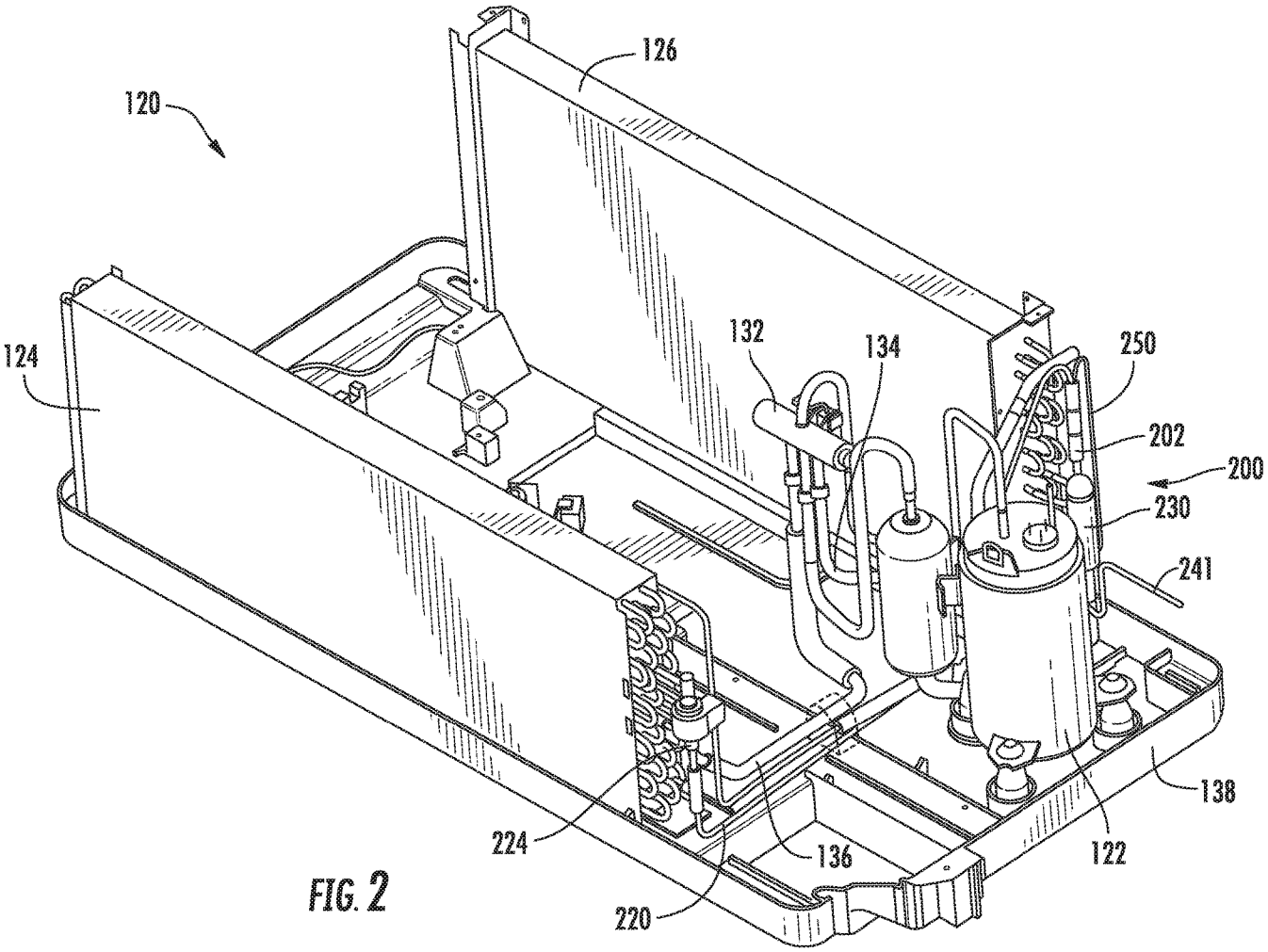
FIG. 2 provides a perspective view of a sealed system of the example packaged terminal air conditioner unit of FIG. 1.
Figure 3:
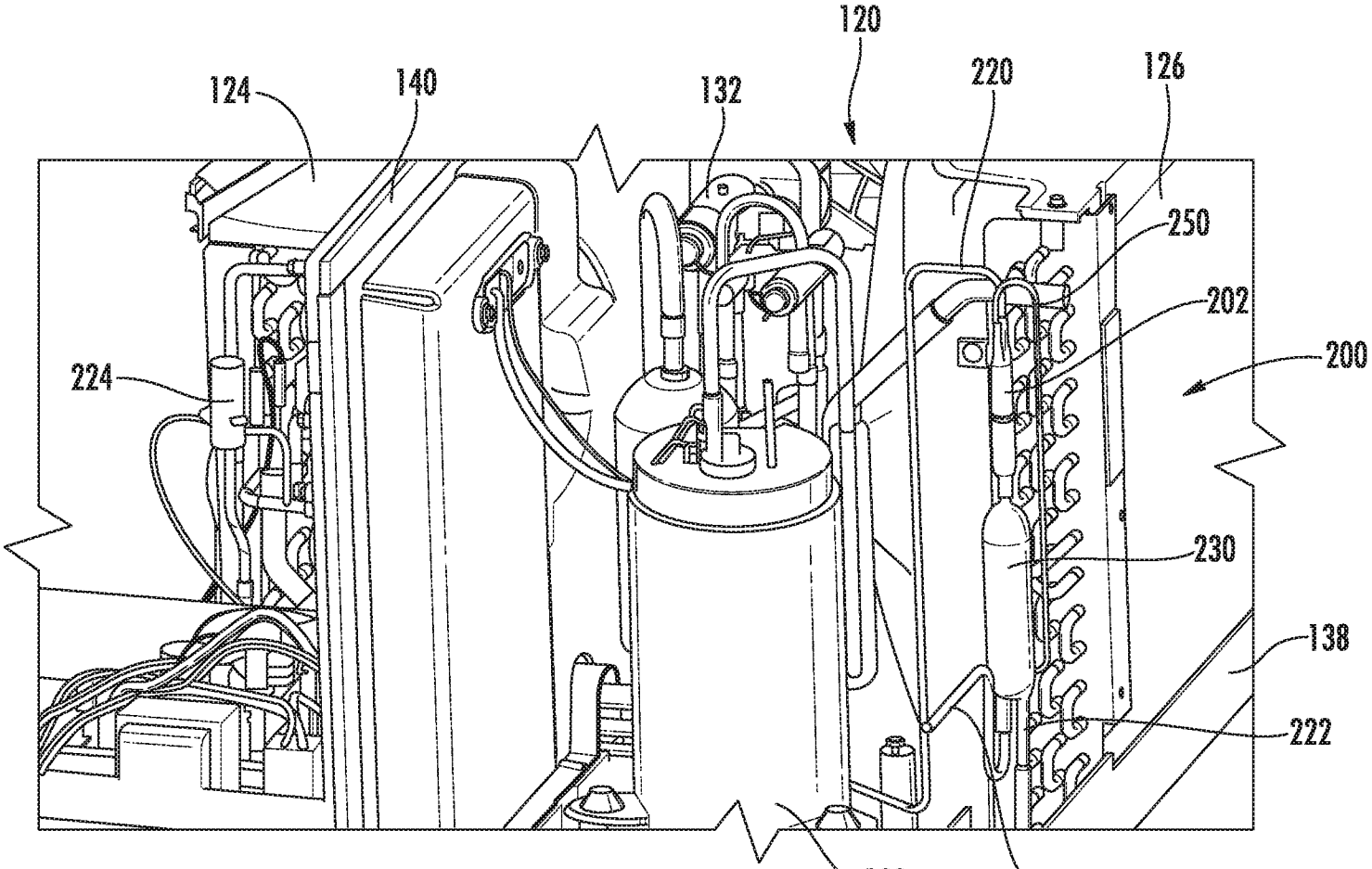
FIG. 3 provides another perspective view of a sealed system of the example packaged terminal air conditioner unit of FIG. 1.
Figure 4:
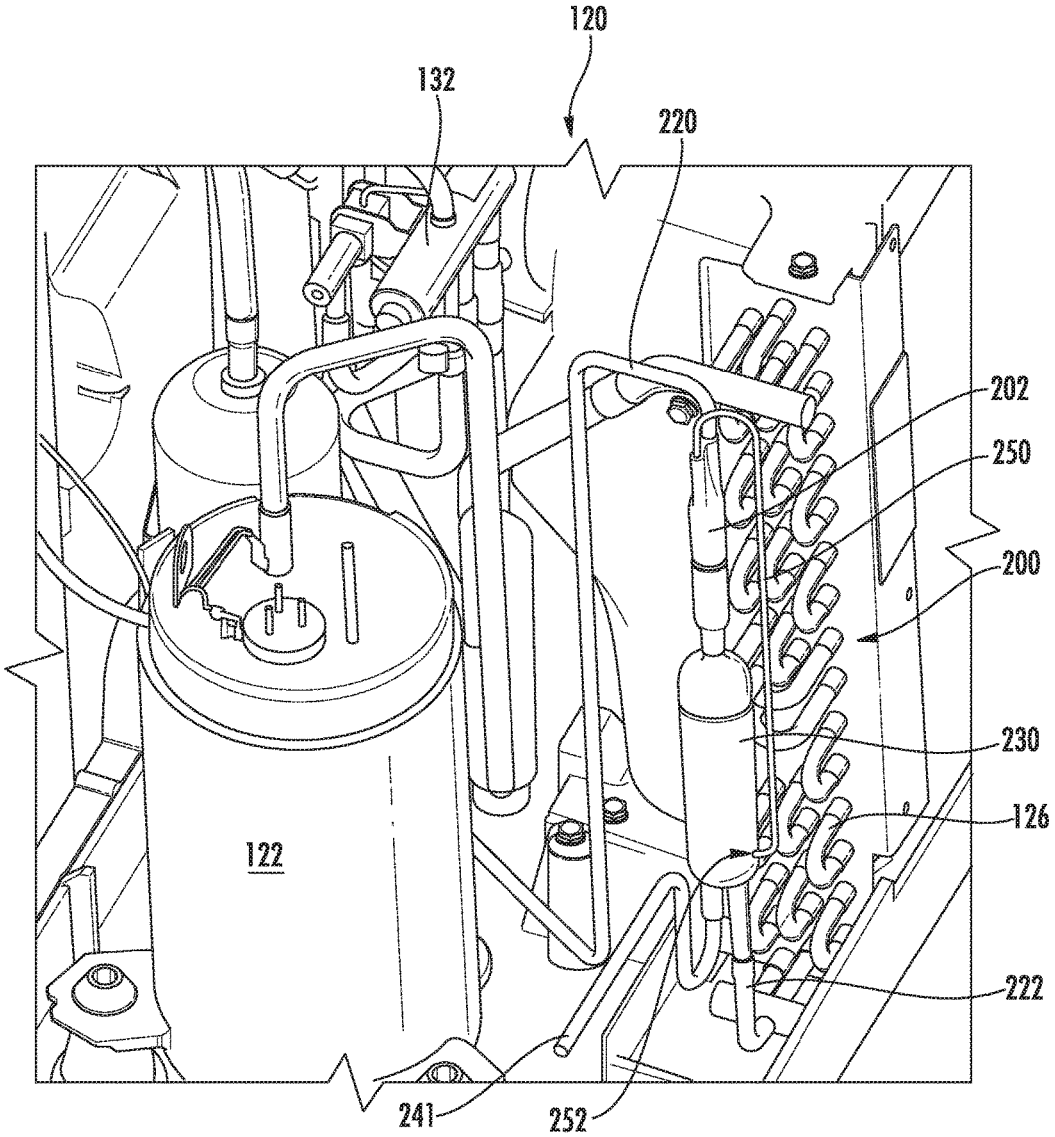
FIG. 4 provides another perspective view of a sealed system of the example packaged terminal air conditioner unit of FIG. 1.
Figure 5:
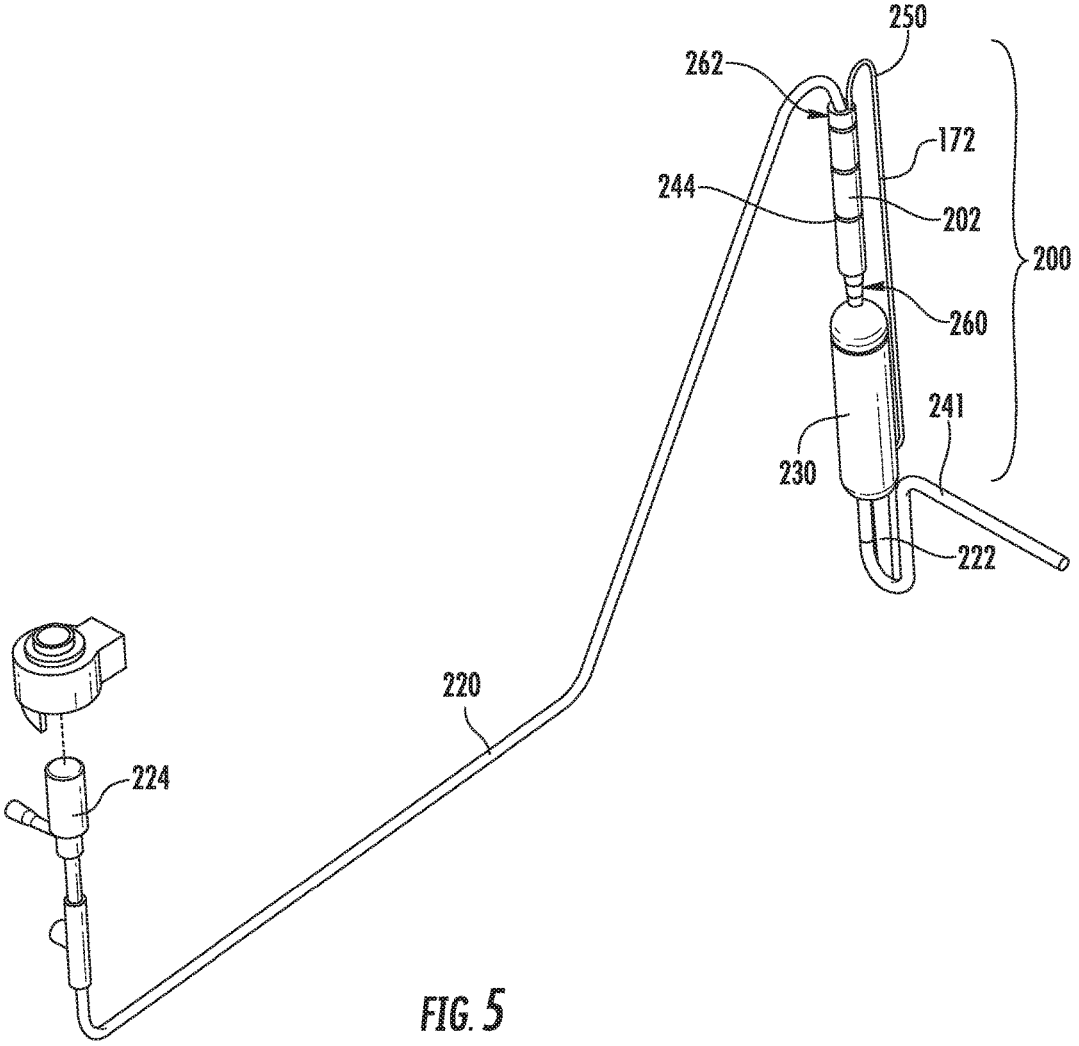
FIG. 5 provides a perspective view of a portion of the example sealed system of FIG. 2.

FIGS. 2 through 4 provide various perspective views of certain components of packaged terminal air conditioner unit 100, including sealed system 120. FIG. 5 provides a perspective view of a portion of sealed system 120. As shown, sealed system 120 includes a compressor 122, an interior heat exchanger or coil 124 and an exterior heat exchanger or coil 126. As is generally understood, compressor 122 is generally operable to circulate or urge a flow of refrigerant (e.g., as indicated by reference numeral 270 in FIGS. 8 and 9) through sealed system 120, which may include various conduits which may be utilized to flow refrigerant between the various components of sealed system 120. Thus, interior coil 124 and exterior coil 126 may be between and in fluid communication with each other and compressor 122.

As will be described in further detail below, sealed system 120 may operate in a cooling mode and, alternately, a heating mode. During operation of sealed system 120 in the cooling mode, refrigerant generally flows from interior coil 124 and to compressor 122. During operation of sealed system 120 in the heating mode, refrigerant generally flows from exterior coil 126 and to compressor 122. As will be explained in more detail below, a compression reversing valve 132 in fluid communication with compressor 122 may control refrigerant flow to and from compressor 122, as well as the coils 124, 126.

Figure 6:
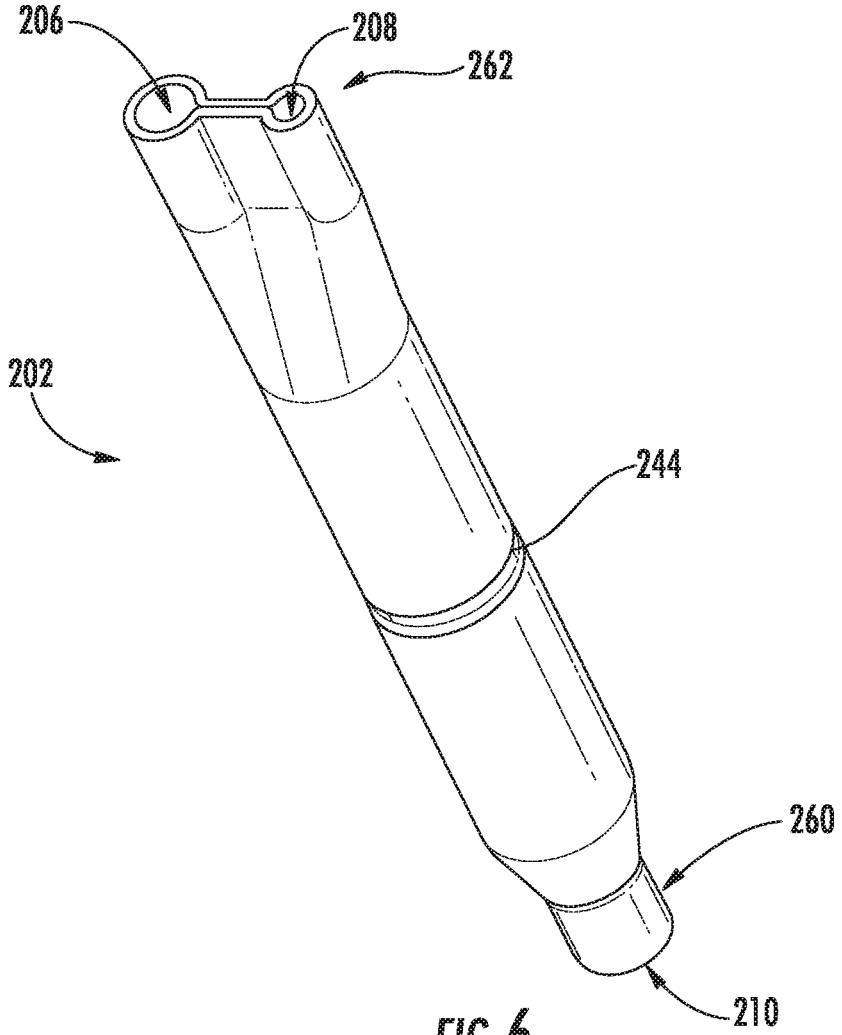
FIG. 6 provides a perspective view of a check valve assembly of the exemplary sealed system of FIG. 2.
Figure 7:
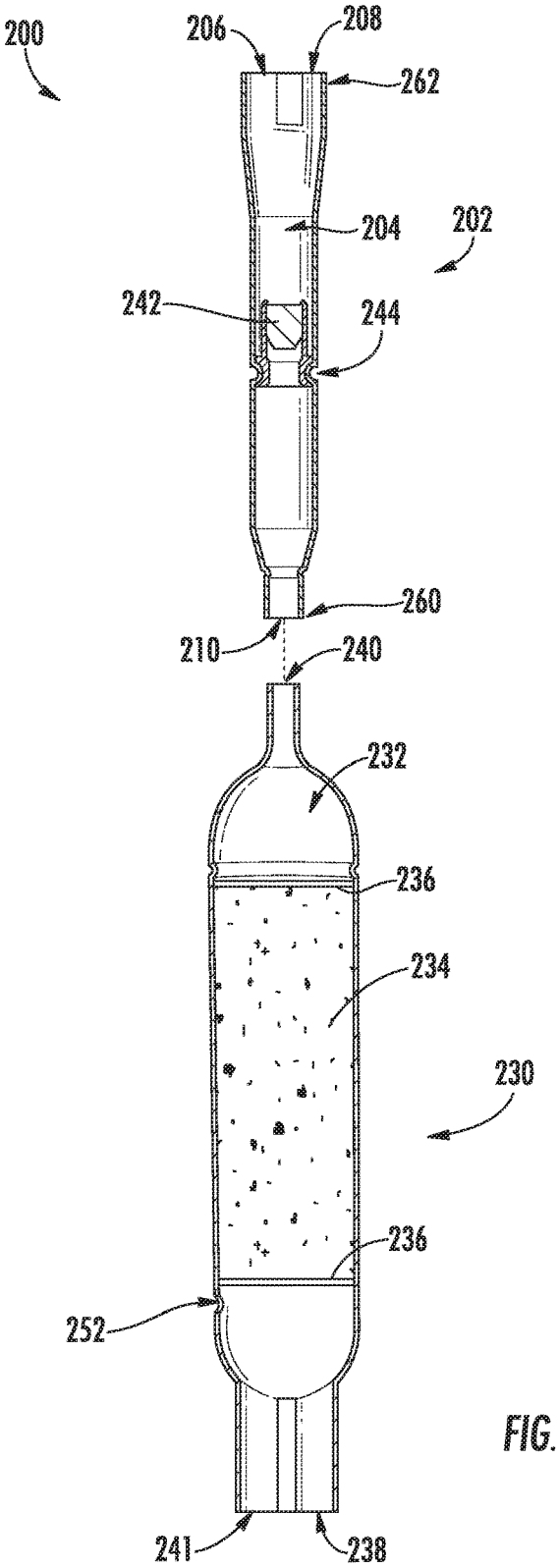
FIG. 7 provides an exploded, cross sectional view of the exemplary check valve assembly of FIG. 6 and a line filter assembly of the exemplary sealed system of FIG. 2.

Referring to FIGS. 5 through 7, a line filter assembly 200 will be described according to an exemplary embodiment of the present subject matter. In general, line filter assembly 200 is positioned between and fluidly couples indoor heat exchanger 124 and outdoor heat exchanger 126. In this regard, line filter assembly 200 will be used generally to refer to components forming the entire refrigerant flow path between indoor heat exchanger 124 and outdoor heat exchanger 126. Although one exemplary configuration of line filter assembly 200 is described below, it should be appreciated that various alternative components may be used, different conduit paths may be formed, and other alterations may be made to line filter assembly 200 while remaining within the scope of the present subject matter.

According to the illustrated exemplary embodiment, line filter assembly 200 includes a housing 202 that defines a flow chamber 204 through which the flow of refrigerant 270 may pass during operation of sealed system 120. Housing 202 further defines a plurality of ports through which refrigerant may enter and exit flow chamber 204. More specifically, according to the illustrated embodiment, housing defines an indoor port 206, a bypass port 208, and an outdoor port 210.

In addition, line filter assembly 200 includes a plurality of conduits which provide communication between housing 202 and indoor heat exchanger 124 and outdoor heat exchanger 126. More specifically, line filter assembly 200 includes an indoor conduit 220 that extends between indoor port 206 and indoor heat exchanger 124 to provide fluid communication between flow chamber 204 and indoor heat exchanger 124. Similarly, line filter assembly 200 includes an outdoor conduit 222 that extends between outdoor port 210 and outdoor heat exchanger 126 to provide fluid communication between flow chamber 204 and outdoor heat exchanger 126. According to the illustrated embodiment, a variable electronic expansion valve 224 may be further provided along indoor conduit 220 for purposes described below.

Line filter assembly 200 may further include a line filter 230 that is positioned between indoor heat exchanger 124 and outdoor heat exchanger 126. Line filter 230 is generally configured for removing or collecting contaminants from the flow of refrigerant, such as byproducts from brazing or other manufacturing processes, that may have accumulated within sealed system 120 (e.g., during assembly) and might otherwise damage moving elements (e.g., compressor 122) or restrict small orifices (e.g., at expansion device 224). In this regard, line filter 230 may generally define a filter chamber 232 that contains or holds a filter media 234 to collect contaminates as the flow of refrigerant is directed therethrough. Additionally or alternatively, line filter 230 may contain or hold a desiccant material, such as a zeolite molecular sieve, to remove undesired moisture that may be present in sealed system 120. In some embodiments, line filter 230 is a uni-directional filter configured to filter flowed refrigerant in a single direction (e.g., the "cooling direction"). According to still other embodiments, line filter 230 may include one or more filter screens 236 which are configured for retaining filter media 234 and/or desiccant material within filter chamber 232.

According to the illustrated embodiment, line filter 230 is operably coupled to outdoor conduit 222. More specifically, line filter 230 may define a first port 238 positioned proximate outdoor heat exchanger 126 and a second port 240 that is positioned proximate housing 202. As illustrated, second port 240 is fluidly coupled or directly attached to outdoor port 210 of housing 202. In this manner, for example, during a cooling mode when the refrigerant flows from outdoor heat exchanger 126 to indoor heat exchanger 124, the flow of refrigerant passes first through line filter 230 and then through housing 202 before passing to the indoor heat exchanger 124. According to an exemplary embodiment, filter media 234 collects contaminants within the refrigerant as it flows in this direction. As best illustrated in FIGS. 5 and 7, line filter 230 may further define a charge port 241 which sealed system 120 may be charged with refrigerant during assembly. Notably, charge port 241 may be sealed closed after charging such that it has no effect on the flow of refrigerant 270 during operation of sealed system 120.

Notably, sealed system 120 is configured for two modes of operation (e.g., heating and cooling) which are achieved by reversing the flow of refrigerant within sealed system 120. However, reversing the flow of refrigerant through line filter 230 will have a tendency to eject all collected particles or contaminants out of filter media 234, back into the flow of refrigerant, and into outdoor heat exchanger 126.

To prevent this, a check valve 242 may be positioned downstream of line filter 230 or filter media 234 when the flow is passing in the cooling mode direction. More specifically, check valve 242 may be positioned within housing 202 for preventing the flow of refrigerant from passing from indoor port 206 to the outdoor port 210. In this manner, the flow of refrigerant may pass through filter media 234 in only one flow direction. Check valve 242 may be any suitable type of one-way valve or device that permits flow in one direction but prevents it in the other direction. As illustrated, housing 202 may define a notch or indentation 244 that is configured for fixing check valve 242 in place within flow chamber 204. Although check valve 242 is illustrated herein as preventing flow from indoor heat exchanger 124 to outdoor heat exchanger 126, it should be appreciated that a similar effect may be achieved by reversing line filter assembly 200 such that check valve 242 prevents flow from outdoor heat exchanger 126 to indoor heat exchanger 124. Other configurations are possible and within the scope of the present subject matter.

Notably, by preventing the flow of refrigerant circulating through line filter 230 in a reverse direction, sealed system 120 must include some feature or path for allowing circulation of the flow of refrigerant in that reverse direction, e.g., around line filter 230. According to the illustrated embodiment, this is achieved by including a bypass conduit 250 that provides fluid communication between bypass port 208 defined on housing 202 and a location upstream of filter media 234 (e.g., in the cooling mode), such as between filter media 234 and outdoor heat exchanger 126.

In this regard, for example, a bypass discharge 252 may be defined within sealed system 120 at a location between filter media 234 and outdoor heat exchanger 126. According to the illustrated embodiment, bypass discharge 252 is defined by line filter 230, e.g., at a location upstream of filter media 234 (in cooling mode). In other words, filter media 234 is positioned between bypass discharge 252 and check valve 242 or housing 202, and bypass discharge 252 is positioned between filter media 234 and outdoor heat exchanger 126. In this manner, bypass conduit 250 provides fluid communication between flow chamber 204 (i.e., via bypass port 208) and outdoor conduit 222 (i.e., via bypass discharge 252) to allow the flow of refrigerant to pass through sealed system 120 around filter media 234 during a heating mode, which will be described in more detail below.

Although bypass discharge 252 is illustrated as being defined by line filter 230, it should be appreciated that it may be instead be defined or positioned at any location upstream of line filter 234 (in the cooling mode). In this regard, for example, bypass discharge 252 may be defined directly on or merge into outdoor conduit 222 or may be directly fluidly coupled to outdoor heat exchanger 126.

Notably, conduits throughout sealed system 120 may be different sizes for optimal performance. For example, indoor conduit 220, outdoor conduit 222, and bypass conduit 250 may all have different cross-sectional areas. Thus, it may be desirable to form housing 202 such that the associated fluid ports have a suitable cross sectional area for coupling with these conduits. Therefore, according to an exemplary embodiment of the present subject matter, indoor port 206 defines a first cross-sectional area, bypass port 208 defines a second cross-sectional area, and outdoor port 210 defines a third cross-sectional area. According to one embodiment, each of these cross-sectional areas are different. Specifically, according to one embodiment the second cross-sectional area that is smaller than the first cross-sectional area, or the first cross-sectional area is greater than or equal to two times the second cross-sectional area.

According to an exemplary embodiment, 202 is formed from a single piece of conduit, e.g. such as copper tubing. In addition, as best illustrated in FIGS. 6 and 7, outdoor port 210 is defined at a first end 260 of housing 202 and both indoor port 206 and bypass port 208 defined at a second end 262 of housing 202. According to an exemplary embodiment, indoor port 206 and bypass port 208 are formed by crimping second end 262 of housing 202. In this manner, the single piece of copper tubing is subdivided into two ports having different cross-sectional areas for improved coupling with indoor conduit 220 and bypass conduit 250. Forming housing 202 as described above results in an easy to assemble line filter assembly 200 that can enable improved sealed system 120 operation and reliability.

Figure 8:
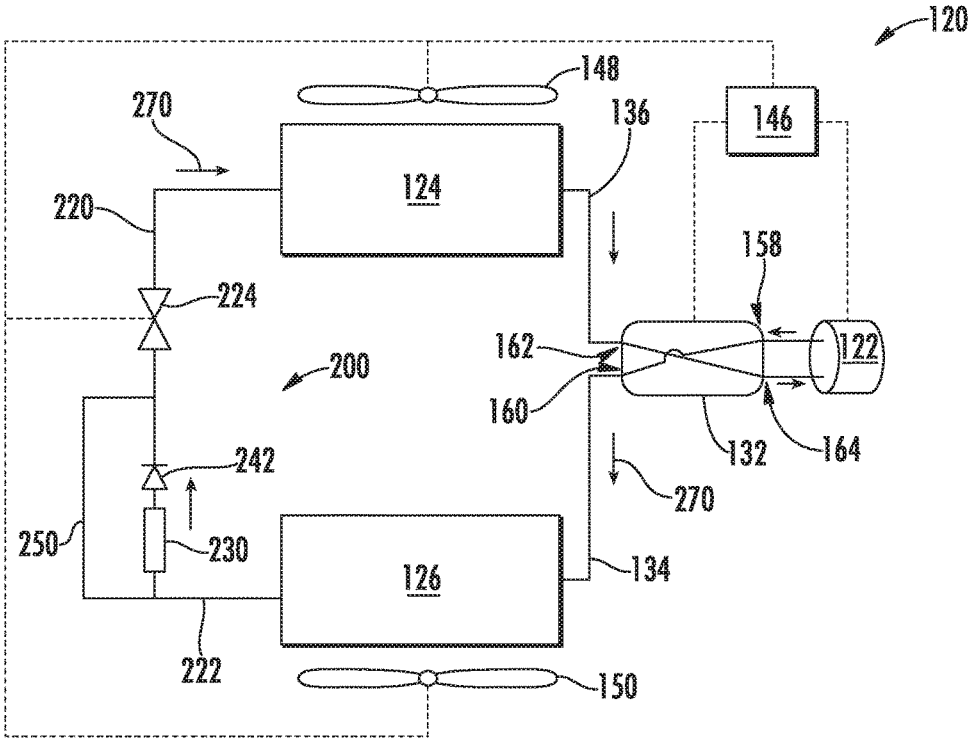
FIG. 8 provides a schematic view of certain components of a sealed system according to example embodiments of the present disclosure, wherein the sealed system is operating in a cooling mode.
Figure 9:
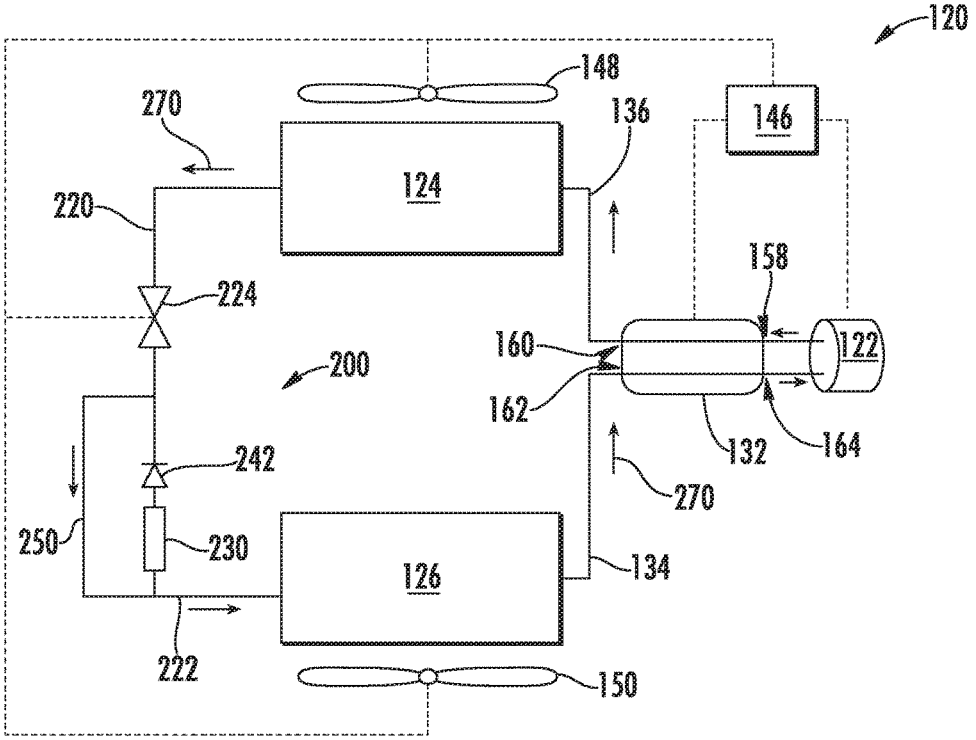
FIG. 9 provides a schematic view of certain components of a sealed system according to example embodiments of the present disclosure, wherein the sealed system is operating in a heating mode.

Turning now to FIGS. 8 and 9, schematic views of sealed system 120 are provided to facilitate a description of two operating modes of sealed system 120. Specifically, FIG. 8 provides a schematic view of sealed system 120 in a cooling mode, and FIG. 9 provides a schematic view of sealed system 120 in a heating mode. As will be described in detail below, during the cooling mode, flow of refrigerant 270 will generally be flowed in a first flow direction (e.g., from compressor 122 and to exterior coil 126 before interior coil 124). By contrast, during the heating mode, flow of refrigerant 270 will generally be flowed in a second flow direction that is opposite from the first flow direction (e.g., from compressor 122 and to interior coil 124 before exterior coil 126).

As noted above, compressor 122 is operable to increase a pressure of a flowed refrigerant within and flowing through sealed system 120. The compressor 122 may be reversible or, alternatively, configured to compress refrigerant in only a single direction. In some embodiments, sealed system 120 includes a compression reversing valve 132. As shown, compression reversing valve 132 may be disposed across sealed system 120. An initial inlet 158 of compression reversing valve 132 is in fixed fluid communication downstream of compressor 122, and a return outlet 164 is in fixed fluid communication upstream of compressor 122. An initial outlet 160 and return inlet 162 are in selective fluid communication with interior coil 124 and exterior coil 126, e.g., according to an operation mode.

During use, compression reversing valve 132 alternately directs the compressed refrigerant in a first flow direction (FIG. 8, e.g., cooling mode) and a second flow direction (FIG. 9, e.g., heating mode). Specifically, compression reversing valve 132 selectively directs compressed refrigerant from compressor 122 to either interior coil 124 or exterior coil 126. For example, in a cooling mode, compression reversing valve 132 is arranged or configured to direct compressed refrigerant from compressor 122 to exterior coil 126. Conversely, in a heating mode, compression reversing valve 132 is arranged or configured to direct compressed refrigerant from compressor 122 to interior coil 124. Thus, compression reversing valve 132 permits sealed system 120 to selectively alternate between the heating mode and the cooling mode.

As shown, compression reversing valve 132 may be operably coupled to controller 146, e.g., as an electronic valve. Controller 146 may thus be further configured to set the flow direction or arrangement of compression reversing valve 132 based on the current mode.

During operation of sealed system 120 in the cooling mode, refrigerant flows from interior coil 124 and to compressor 122. For example, refrigerant may exit interior coil 124 as a fluid in the form of a superheated vapor. Upon exiting interior coil 124, the refrigerant may enter compressor 122, which is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects compression reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 150 is positioned adjacent exterior coil 126 and may facilitate or urge a flow of air from the exterior atmosphere across exterior coil 126 in order to facilitate heat transfer.

Variable electronic expansion valve 224 is disposed along indoor conduit 220 between interior coil 124 and exterior coil 126. During use, variable electronic expansion valve 224 may generally expand the refrigerant, lowering the pressure and temperature thereof. In the cooling mode, refrigerant, which may be in the form of high liquid quality/saturated liquid vapor mixture, may exit housing 202 and travel through variable electronic expansion valve 224 before flowing through interior coil 124. In the heating mode, refrigerant, may exit interior coil 124 and travel through variable electronic expansion valve 224 before flowing through bypass conduit 250 to exterior coil 126.

Variable electronic expansion valve 224 is generally configured to be adjustable. In other words, the flow (e.g., volumetric flow rate in milliliters per second) of refrigerant through variable electronic expansion valve 224 may be selectively varied or adjusted. In some such embodiments, variable electronic expansion valve 224 is operably coupled to controller 146, as shown. Accordingly, controller 146 may be configured to vary the flow of refrigerant based on, for instance, whether sealed system 120 is operating in the cooling mode or heating mode. Advantageously, the expansion of refrigerant may be selectively optimized with multiple operating modes while using only a single expansion device.

Interior coil 124 is disposed downstream of variable electronic expansion valve 224 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from variable electronic expansion valve 224 may enter interior coil 124 via indoor conduit 220. Within interior coil 124, the refrigerant from variable electronic expansion valve 224 receives energy from the interior atmosphere and vaporizes into superheated vapor and/or high quality vapor mixture. An interior air handler or fan 148 is positioned adjacent interior coil 124 and may facilitate or urge a flow of air from the interior atmosphere across interior coil 124 in order to facilitate heat transfer. From interior coil 124, refrigerant may return to compressor 122 from compression reversing valve 132, e.g., via a second conduit 136 that extends between and fluidly connects interior coil 124 and compression reversing valve 132.

During operation of sealed system 120 in the heating mode, compression reversing valve 132 reverses the direction of refrigerant flow from compressor 122. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of variable electronic expansion valve 224 in the heating mode and acts as an evaporator, e.g., such that exterior coil 126 is operable to heat refrigerant within exterior coil 126 with energy from the exterior atmosphere at exterior side portion 114 of casing 110.

One or more components of sealed system may be selectively variable components. In other words, the operating states or speeds of such components may be adjusted according to one or more conditions. In some such embodiments, compressor 122 is a variable speed compressor operably coupled to controller 146. Accordingly, controller 146 may be configured to vary the operating speed (e.g., rotation speed) of compressor 122 based on, for instance, whether sealed system 120 is operating in the cooling mode or heating mode. In turn, the flow (e.g., volumetric flow rate in milliliters per second) of refrigerant from compressor 122 may be varied in magnitude according to the current operational mode. Specifically, a discrete cooling speed and a discrete heating speed may be provided based on, e.g., predetermined testing data indicating heat exchange performance for the respective operating mode. Controller 146 may be programmed or configured to initiate the discrete cooling speed in the first flow direction and the discrete heating speed in the second flow direction. During use of sealed system 120 the absolute volumetric flow rate of refrigerant in the first flow direction may thus be different from the absolute volumetric flow rate of refrigerant in the second flow direction.

In additional or alternative embodiments, one or both of fan 150 and fan 148 may be variable speed fans. Controller 146 may thus be configured to tune or alternate the speed of fan(s) 150, 148 based on whether sealed system 120 is being operated in the cooling mode or heating mode. Discrete cooling speeds and discrete heating speeds may be provided based on, e.g., predetermined testing data indicating heat exchange performance for the respective operating mode. The speeds may generally correspond to rotation speed of the fan(s) 150, 148 (e.g., in revolutions per second) or airflow speed (e.g., as a volumetric flow rate of air across exterior coil 126 or interior coil 124). Thus, the speed at which fan(s) 150, 148 blows ambient air across the respective exterior coil 126 or interior coil 124 when refrigerants flows in the first flow direction may be different from the speed at which fan(s) 150, 148 blows air when refrigerants flows in the second flow direction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit, comprising:

a bulkhead positioned within a casing and defining an interior side portion and an exterior side portion;

an outdoor heat exchanger disposed in the exterior side portion;

an indoor heat exchanger disposed in the interior side portion;

a compressor operable to urge a flow of refrigerant through the indoor heat exchanger and the outdoor heat exchanger; and a line filter assembly fluidly coupling the indoor heat exchanger to the outdoor heat exchanger, the line filter assembly comprising:

a housing defining an indoor port having a first cross sectional area, a bypass port having a second cross sectional area smaller than the first cross sectional area, and an outdoor port;

an indoor conduit providing fluid communication between the indoor port and the indoor heat exchanger;

an outdoor conduit providing fluid communication between the outdoor port and the outdoor heat exchanger;

a line filter operably coupled to the outdoor conduit for filtering the flow of refrigerant, the line filter defining a bypass discharge positioned between a filter media and the outdoor heat exchanger;

a check valve positioned within the housing, the check valve being configured for preventing the flow of refrigerant from passing from the indoor port to the outdoor port; and a bypass conduit extending between the bypass port and the bypass discharge to provide fluid communication between the bypass port and the outdoor conduit.

2. The packaged terminal air conditioner unit of claim 1, wherein the first cross sectional area is greater than or equal to two times the second cross sectional area.

3. The packaged terminal air conditioner unit of claim 1, wherein the outdoor port defines a third cross sectional area, and wherein the first cross sectional area, the second cross sectional area, and the third cross sectional area are all different.

4. The packaged terminal air conditioner unit of claim 1, wherein the outdoor port is defined at a first end of the housing and the indoor port and bypass port are defined at a second end of the housing.

5. The packaged terminal air conditioner unit of claim 4, wherein the indoor port and the bypass port are formed by crimping the second end of the housing.

6. The packaged terminal air conditioner unit of claim 1, wherein the housing is formed from a single piece of tubing.

7. The packaged terminal air conditioner unit of claim 1, wherein the line filter is positioned between the check valve and the outdoor heat exchanger.

8. The packaged terminal air conditioner unit of claim 1, further comprising:

an expansion device operably coupled to the indoor conduit between the housing and the indoor heat exchanger.

9. The packaged terminal air conditioner unit of claim 8, wherein the expansion device is an electronic expansion device.

10. The packaged terminal air conditioner unit of claim 1, further comprising a reversing valve operably coupling the compressor to both the indoor heat exchanger and the outdoor heat exchanger, the reversing valve configured for directing a compressed flow of refrigerant in a first flow direction during a cooling mode and an opposite second direction during a heating mode.

11. The packaged terminal air conditioner unit of claim 10, wherein the flow of refrigerant passes from the reversing valve to the outdoor heat exchanger, through the line filter and check valve, and to the indoor heat exchanger through the indoor conduit in the cooling mode.

12. The packaged terminal air conditioner unit of claim 10, wherein the flow of refrigerant passes from the reversing valve to the indoor heat exchanger, through the indoor conduit, and through the bypass conduit and the outdoor conduit to the outdoor heat exchanger in the heating mode.

13. A line filter assembly for a sealed heat exchange system, the line filter assembly comprising:

a housing defining an indoor port having a first cross sectional area, a bypass port having a second cross sectional area smaller than the first cross sectional area, and an outdoor port;

a check valve positioned within the housing, the check valve being configured for preventing a flow of refrigerant from passing from the indoor port to the outdoor port;

a line filter fluidly coupled to the outdoor port of the housing and comprising a filter media for filtering the flow of refrigerant, the line filter defining a bypass discharge;

a bypass conduit providing fluid communication between the bypass port and the bypass discharge, the filter media being positioned between the bypass discharge and the housing; and wherein the outdoor port is defined at a first end of the housing and the indoor port and bypass port are defined at a second end of the housing.

14. A packaged terminal air conditioner unit, comprising:

a bulkhead positioned within a casing and defining an interior side portion and an exterior side portion;

an outdoor heat exchanger disposed in the exterior side portion;

an indoor heat exchanger disposed in the interior side portion;

a compressor operable to urge a flow of refrigerant through the indoor heat exchanger and the outdoor heat exchanger; and a line filter assembly fluidly coupling the indoor heat exchanger to the outdoor heat exchanger, the line filter assembly comprising:

a housing defining an indoor port having a first cross sectional area, a bypass port having a second cross sectional area smaller than the first cross sectional area, and an outdoor port defined at a first end of the housing, wherein the indoor port and bypass port are defined at a second end of the housing;

an indoor conduit providing fluid communication between the indoor port and the indoor heat exchanger;

an outdoor conduit providing fluid communication between the outdoor port and the outdoor heat exchanger;

a line filter operably coupled to the outdoor conduit for filtering the flow of refrigerant;

a check valve positioned within the housing, the check valve being configured for preventing the flow of refrigerant from passing from the indoor port to the outdoor port; and a bypass conduit providing fluid communication between the bypass port and the outdoor conduit.

15. The packaged terminal air conditioner unit of claim 14, wherein the first cross sectional area is greater than or equal to two times the second cross sectional area, and wherein the outdoor port defines a third cross sectional area, and wherein the first cross sectional area, the second cross sectional area, and the third cross sectional area are all different.

16. The packaged terminal air conditioner unit of claim 14, wherein the indoor port and the bypass port are formed by crimping the second end of the housing.

17. The packaged terminal air conditioner unit of claim 14, wherein the housing is formed from a single piece of tubing.

18. The packaged terminal air conditioner unit of claim 14, wherein the line filter is positioned between the check valve and the outdoor heat exchanger.

19. The packaged terminal air conditioner unit of claim 14, wherein the bypass conduit extends between the bypass port and a bypass discharge defined by the line filter, the bypass discharge being positioned between a filter media and the outdoor heat exchanger.

* * * * *